United States Patent [19]

Knetzger

[11] 4,300,770

[45] Nov. 17, 1981

[54] ELECTRONIC BOARD GAME

[75] Inventor: Robert C. Knetzger, Redondo Beach, Calif.

[73] Assignee: Mattel, Inc., Hawthorne, Calif.

[21] Appl. No.: 119,713

[22] Filed: Feb. 8, 1980

[51] Int. Cl.[3] ..... A63F 3/00

[52] U.S. Cl. ..... 273/238; 273/249

[58] Field of Search ..... 273/238, 248, 249, 250, 273/251, 237, 1; 35/9 C

[56] References Cited

U.S. PATENT DOCUMENTS

| | | | |
|---|---|---|---|
| 1,043,318 | 11/1912 | Jackson | 273/238 |
| 1,524,740 | 2/1925 | Lorenz | 273/251 |
| 2,036,603 | 4/1936 | Pallada | 273/86 B |
| 2,604,323 | 7/1952 | Smith | 273/86 F |
| 2,698,180 | 12/1954 | Hersh | 273/86 B |
| 3,237,341 | 3/1966 | Janning | 273/238 |
| 3,460,425 | 8/1969 | Kiepe | 35/9 C |
| 4,000,489 | 12/1976 | Bench | 273/1 |
| 4,090,713 | 5/1978 | DeCesare | 273/86 B |
| 4,103,895 | 8/1978 | Pressman | 273/DIG. 28 |

FOREIGN PATENT DOCUMENTS

| | | | |
|---|---|---|---|
| 920164 | 1/1973 | Canada | 273/238 |
| 2445723 | 4/1976 | Fed. Rep. of Germany | 273/238 |

*Primary Examiner*—Richard J. Apley
*Assistant Examiner*—Carl Moy
*Attorney, Agent, or Firm*—Reagin & King

[57] ABSTRACT

An electrical board game is disclosed which includes a track described on a foldable game board and having starting and finishing points and dividing into multiple parallel paths at various points along the track.

The Player moves a players piece along one of the multiple paths and the game detects which path was chosen by the use of electrically conductive circuitry on the board in conjunction with a conductive players piece.

The game includes the ability of the players to randomly designate which of the parallel paths are safe and which are danger through the use of conductive switching elements placed on the game board in a physical orientation which determines the designation of the paths.

An electronic sound generator is provided which is placed on the board and electrically responds to the players choice of path and the designation of that path, and generates either a safe or a danger sound.

9 Claims, 6 Drawing Figures

ELECTRONIC BOARD GAME

BACKGROUND OF THE INVENTION

This invention relates to games and, more particularly to electrical board games for young children.

There have been many board games devised over the years. These games provide entertainment by combining elements of skill and chance. In an effort to provide more entertainment to the players, certain of these games have been constructed with features which are electrically or electronically enhanced. For example, certain games have lights which turn on in response to particular player moves. Other games have bells which sound in response to particular player moves. Games are known in which player positions are selected by making various electrical connections so that an indication of the particular position is given. Most of these prior art games, however, are of such a nature that they may be operated only by relatively sophisticated players such as teenagers or adults. This results because it is usual for such sophisticated games to require various electrical connections to be made and directions to be followed which require an understanding beyond that of the average child. Consequently, there has been little development in electrical or electronic board games for young children.

It is, therefore, an object of this invention to provide a new and improved electrical board game for young children.

It is another object of this invention to provide a board game having electrical connections which may be easily made by young children.

It is an additional object of this invention to provide a board game for young children providing electrically and electronically enhanced responses to the actions of the players.

SUMMARY OF THE INVENTION

The foregoing and other objects of the invention are accomplished by a board game which has a game track or path from a start to a finish. The path divides into multiple parallel paths at various points, and movement of a player's piece along a selected one of the multiple paths gives an audio signal either allowing the player to proceed or directing him to go back.

The multiple paths are defined by electrically conductive printed circuitry laid on the board. The particular paths selected to give the proceed and go back signals are randomly selected by unique switches which are connected to the paths in a manner which makes their operation simple to young children. The audio signals are provided by an electronic sound generating module which is connected to the paths by means of the switches and is itself capable of being connected into the circuit by a young child.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
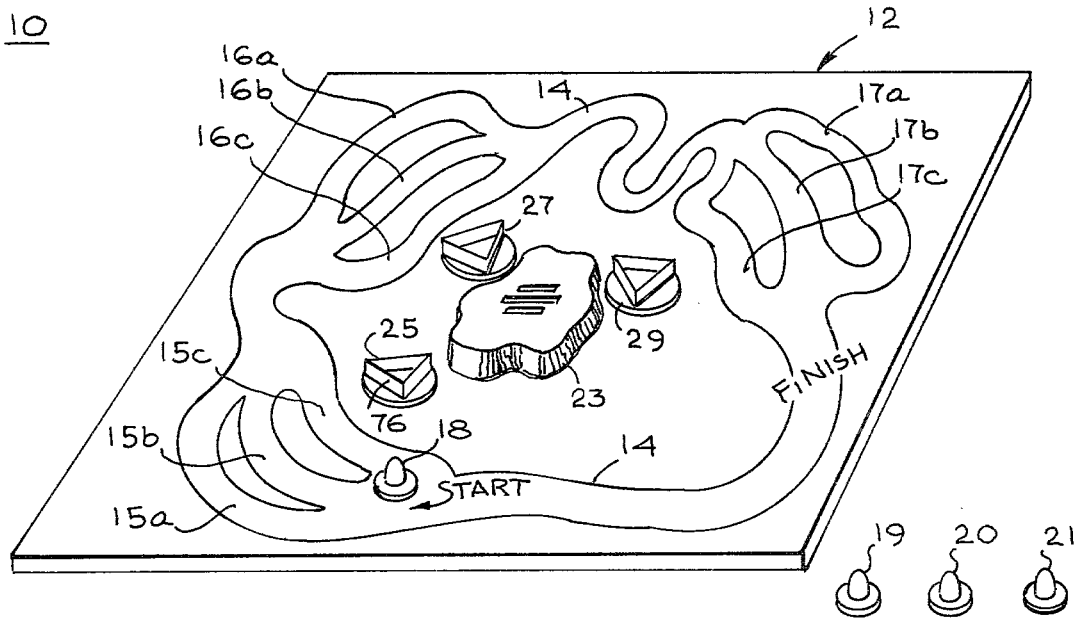
FIG. 1 is a perspective view of a board game constructed in accordance with the invention.

Referring now to FIG. 1, there is shown a board game 10 constructed in accordance with the invention. The game 10 includes a game board 12 which may be constructed of a material such as cardboard or plastic or the like and which carries thereon a main game track or path 14 which begins at a start indication and ends at a finish indication. The path 14 divides at a number of places into multiple paths. In the preferred embodiment shown in FIG. 1, the path 14 divides into three paths 15*a*, 15*b*, and 15*c* over a first interval; into three paths 16*a*, 16*b*, and 16*c* over a second interval; and into three paths 17*a*, 17*b*, and 17*c* over a third interval.

The game 10 also includes a number of playing pieces 18, 19, 20, and 21. Each of the pieces 18–21 is moved along the main path 14 and over the branching paths 15, 16, and 17 from the start to the finish. As will be explained hereinafter, as a playing piece 18–21 is moved over the branching paths 15, 16, and 17, sound indications are given by an electronic module 23 shown positioned in the center of the board 12. The sound emitted indicates either a safe passage or a dangerous passage directing the player to pass or go back, respectively.

The game 10 also includes a number of random selector switches 25, 27, and 29 which are positioned simply by placing them at indicated positions upon the board 12. Each switch 25, 27, and 29 selects, on what appears to a child to be a random basis, which of the multiple paths 15, 16, and 17 are safe and which are dangerous.

The play of the game is such that a player beginning with the player piece 18 on path 14 at start moves to the left as shown in FIG. 1 and makes a first choice as to whether to proceed along path 15*a*, 15*b*, or 15*c*. As the player piece 18 proceeds along a selected path, the module 23 gives a safe or a danger signal. If a player receives a safe signal, he proceeds along path 14 to make a second selection of one of multiple paths 16*a*, 16*b*, or 16*c*. Presuming at this point that the player receives a danger indication, he moves the player piece 18 into the position on path 14 intermediate between paths 15 and 16 and awaits the play of the next players. The first player to pass through each of paths 15, 16, and 17, receiving safe signals at each, arrives at finish and wins the game.

Figure 3:
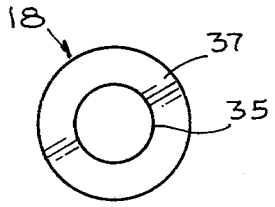
FIG. 3 is a view showing the bottom of a playing piece used in playing the board game shown in FIG. 1.
Figure 2:
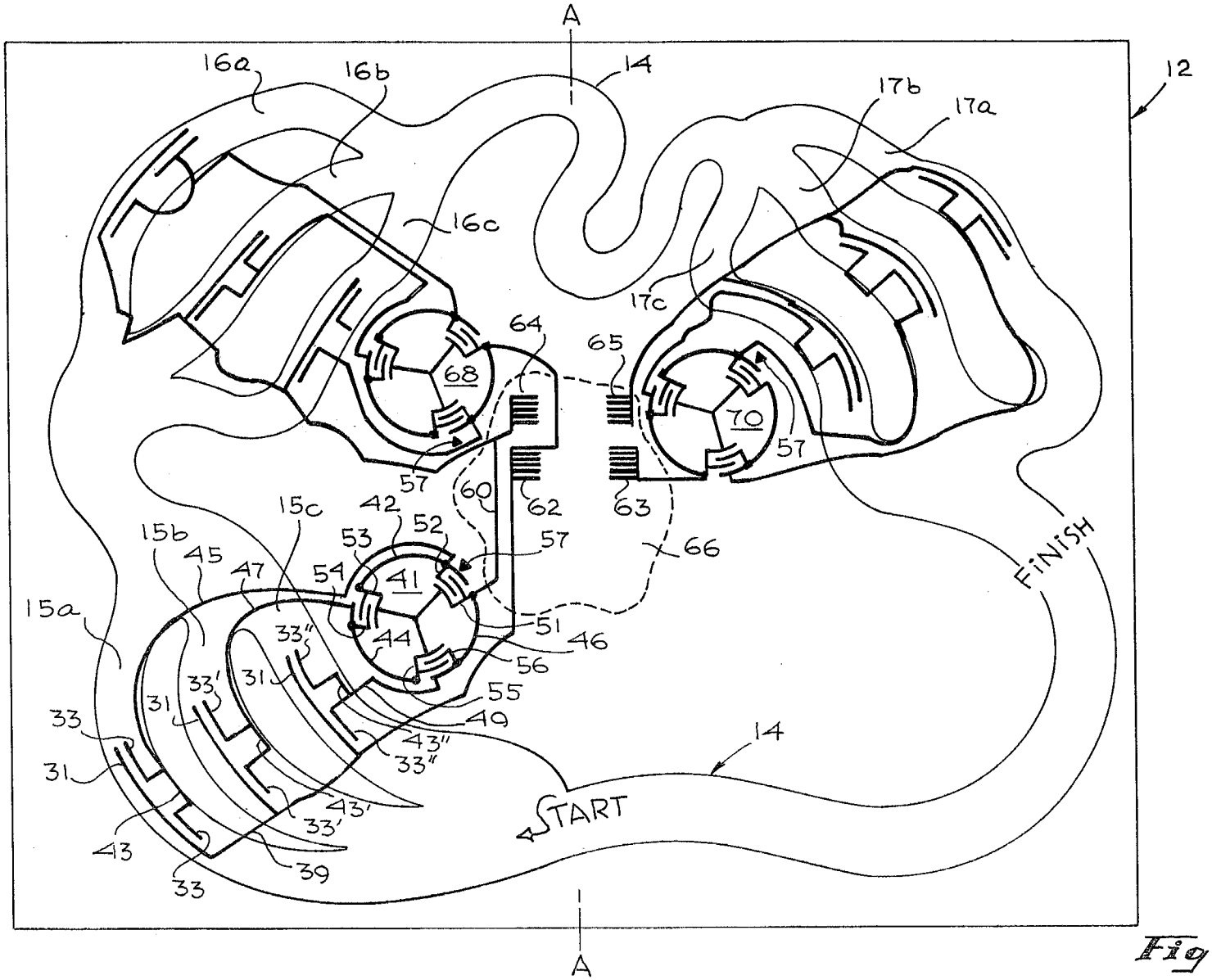
FIG. 2 is a top view of a board which may be used with the board game shown in FIG. 1.
Figure 6:
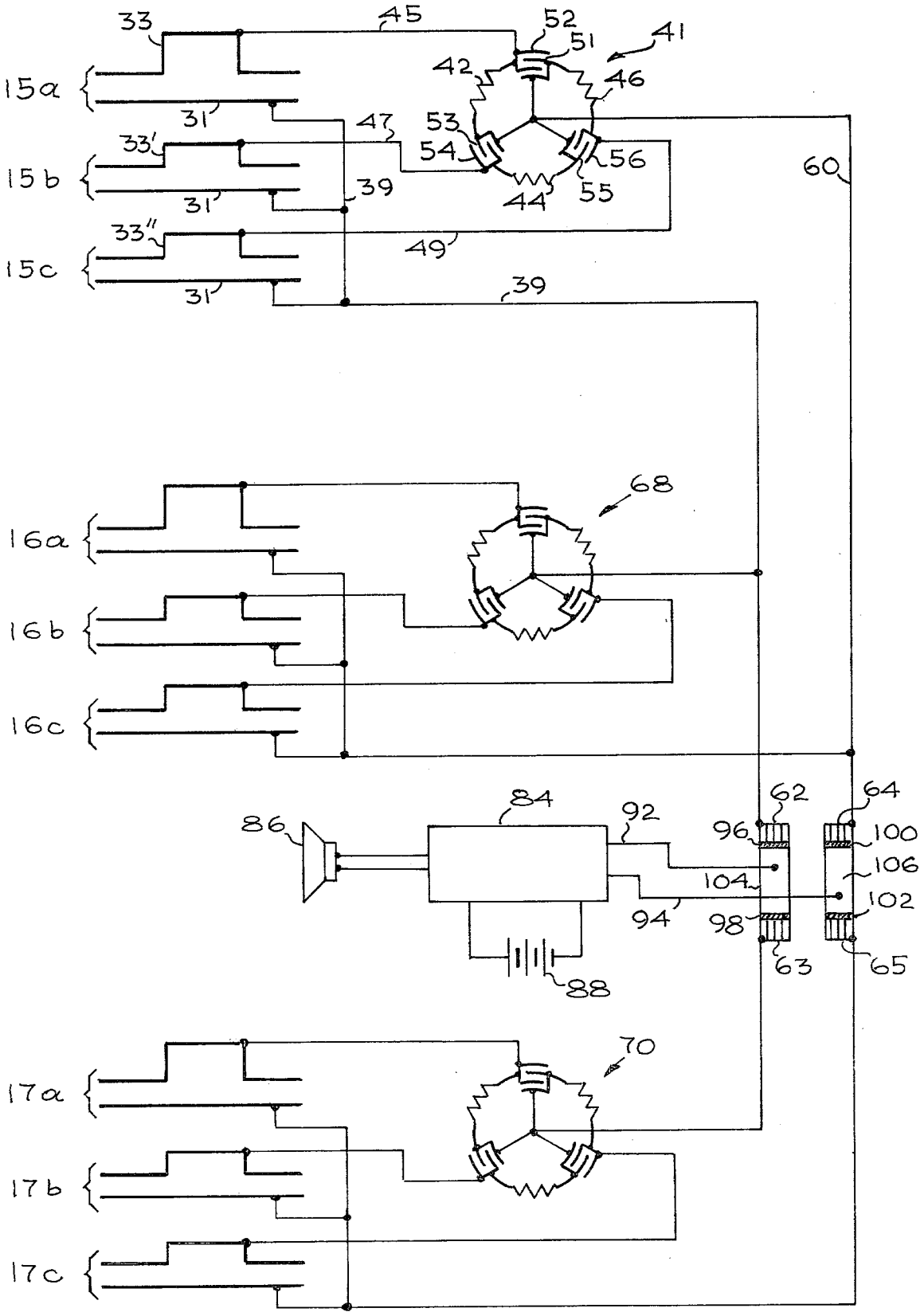
FIG. 6 is a schematic view showing the circuitry of the game of the present invention.

Referring now to FIGS. 2 and 6, there are shown a top view and a schematic view, respectively, of the game board 12 shown in FIG. 1. As may be seen, each of paths 15*a*, 15*b*, and 15*c* includes a pair of strips 31 and 33 (33', 33'') which in a preferred embodiment comprise conductive printed circuitry applied by means of polymer thick film inks or the like manufactured by DuPont and Methode Development Co. Each of these strips is devised to contact a metallic foil or other electrical connector placed on the base of each of the player pieces 18–21 (See FIG. 3). In the preferred embodiment shown in FIG. 3, a metallic foil label 35 is applied by paste or the like to the base 37 of the Figure. As will be understood by those skilled in the art, when a player piece 18–21 moves over a path 15*a*, 15*b*, or 15*c* (or like paths 16 or 17) the label 35 provides an electrical connection between the two strips 31 and 33 (or 31 and 33' or 31 and 33''). It should be noted that the strips 31 and 33 and like strips may be masked by the coloration of the board 12. The strip 31 is connected by a printed conductor 39 to conductive printed pad 62 within the boundary of a position 66 as shown in FIG. 2, upon which the electronic sound generating module 23 is to be positioned. The strips 33 are connected together by a printed conductor 43 and then connected via a separate printed conductor 45 to a position 52 within a circle 41 upon which one of the switches 25, 27, or 29 is placed. As may be seen, each of the strips 31 in paths 15*a*, 15*b*, and 15*c* is connected to the same printed conductor 39 while each of the strips 33, 33' and 33'' of the paths 15*a*, 15*b*, and 15*c*, respectively, is connected to a different printed conductor 45, 47, and 49. At the circle 41, the connections 45, 47, and 49 are connected to different conductive pads 52, 54, and 56. These pads 52, 54, and 56 are then connected by printed resistors 42, 44, and 46 to conductive printed pads 53, 55, and 51, respectively. These latter three pads 53, 55, and 51, are connected in common with each other and are then connected by printed conductor 60 to conductive printed pad 64, located within the boundary of position 66 upon which electronic sound generating module 23 is positioned during game play.

In like manner, each of the paths 16*a*, 16*b*, 16*c*, 17*a*, 17*b*, and 17*c* is connected to a circle 68 or a circle 70 in the manner described with regard to the connection of paths 15*a*, 15*b*, and 15*c*. The conductive pads of paths 16*a*, 16*b*, and 16*c* and the pads of the circle 68 are also connected to the pads 62 and 64 of the position 66, while the conductive pads of paths 17*a*, 17*b*, and 17*c* and the pads of the circle 70 are connected to the pads 63 and 65, also within the boundaries of a position 66 upon which the electronic module 23 is placed in use.

Figure 4:
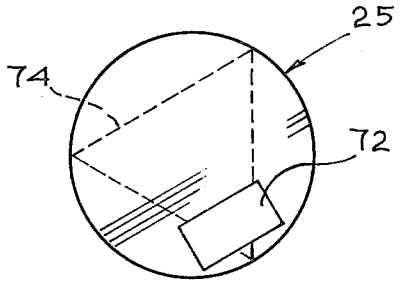
FIG. 4 is a view showing the bottom of a switch which may be used in playing the game shown in FIG. 1.

FIG. 4 shows the bottom of one of the switches 25, 27, or 29 with a metallic foil 72 or other conductive material placed thereon in such a manner that when the switch 25, 27, or 29 is placed on a circle 41, 68, or 70 with the indicator 74 shown in dotted lines in FIG. 4 having any one of its points directed toward the arrows 57 on the board 12 shown surrounding the circles 41, 68, or 70, the strip 72 will make a connection between two of the pads 51–56 and cause the selection (on a basis which will appear random to a child operator) of one of the paths, 15*a*, 15*b*, or 15*c* (or like paths 16 or 17) as a safe path and the other two of the paths as dangerous paths. This will be accomplished in the following manner. The arrangement of the resistive and conductive elements within circle 41 results in a resistive element 42, 44, or 46 being placed electrically in series between each of the strips 33, 33' and 33'' of paths 15*a*, 15*b*, and 15*c*. Conductive pads 51–56 are grouped into closely spaced interdigitated pairs 51–52, 53–54, and 55–56 as shown in FIG. 2. The conductive strip 72 of a switch 25, 27, or 29 serves to bridge across a conductor pair, the interdigitations providing multiple paths to ensure a reliable bridged connection. The result of bridging across a conductor pair 51–52, 53–54, or 55–56 is to short out the resistive element in series with one of the three paths. The circuitry within circles 68 and 70 is connected in a like manner.

The electronic sound generator 23 is connected to the conductive and resistive elements for all paths 15, 16, and 17, and responds to electrical resistance by generating a safe sound for a path with the resistive element shorted out, and a danger sound for the paths which still include the resistive elements.

Figure 5:
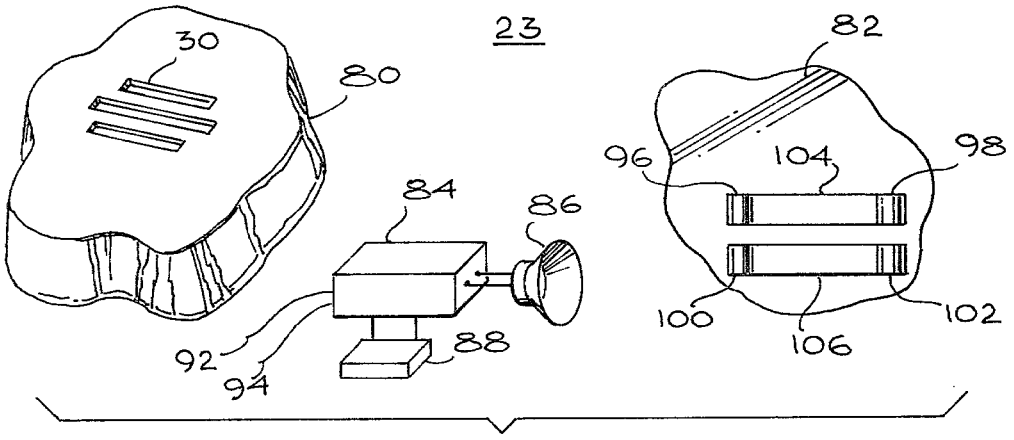
FIG. 5 is an exploded view showing a sound generating module which may be used in playing the game shown in FIG. 1

FIG. 5 shows the arrangement by which the module 23 is connected to the conductive and resistive circuitry described above. FIG. 5 is an exploded view of the module 23 with its lower housing inverted to show the bottom thereof so that the connections thereon may be easily understood. As may be seen in FIG. 5, the module 23 includes an upper housing 80, a lower housing 82, a sound generating circuit 84, a speaker 86 and a battery 88. The upper and lower housings 80 and 82 may be constructed of a material such as a moldable plastic which is well known in the art and useful for containing electronic circuitry. The upper housing 80 has apertures 90 therein through which the sound from the speaker 86 is projected. The sound generating circuitry 84 is of a type well known in the art which generates an output signal at an audio frequency which varies with the resistance placed in the input circuit; the circuit, consequently, is not shown herein. An example of a sound generating circuit which may be used in the present invention is a sound generating kit number 28-215 manufactured and distributed by Radio Shack Corporation. The sound generating circuit is powered by the battery 88 which in a preferred embodiment may be a 9-volt transistor battery. A pair of conductors 92 and 94 lead from the sound generating circuit and connect to conductive strips 104 and 106 shown on the lower surface of the lower housing 82. As will be noted, the outer shape of the lower housing 82 is such as to fit precisely within the outline of the position 66 described on board 12 in FIG. 2. When the module 23 is placed in this position, the conductive tab portions 96, 98, 100, and 102 of conductive strips 104 and 106 respectively, fit over and contact conductive pads 62, 63, 64, and 65.

It is a feature of the invention that the game board 12, with the players pieces 18–21, the switches 25–29, and the sound generating module 23 removed, presents a flat surface and may be folded along the centerline A—A in FIG. 2 for ease of storage. To prevent damage to the printed conductors during folding, the game board 12 is designed to avoid the placement of any conductive paths across or along the folding line A—A. When the sound generating module 23 is placed in its position 66 which straddles the folding line A—A, the conductive tabs 96, 98, 100, and 102 mounted to the bottom surface of the lower housing 82 of module 23 serve to electrically connect the conductive strips on both sides of the folding line A—A of board 12 as shown in FIG. 2 as well as to complete the circuits to the sound generating circuitry. More particularly, tabs 96 and 98 which are electrically common to strip 104 serve to connect in common the conductive pads 62 and 63 which are on opposite sides of folding line A—A in FIG. 2, and to also connect them to the sound generator 84; and, in like manner, tabs 100 and 102 which are electrically common to strip 106 in FIG. 5 serve to connect in common the conductive pads 64 and 65, and to also connect them to the sound generator 84. Thus, placement of the sound generator module 23 on board 12 in position 66 serves the dual purpose of electrically bridging the isolated conductive paths on each side of the folding line A—A of board 12 as well as connecting the conductive paths to the sound generating circuitry 84.

When the switches 25, 27, and 29 are rotated to different arrow positions on the circles 41, 68, and 70, different safe and dangerous paths are selected in each of the multiple paths 15, 16, and 17. Consequently, children playing the game may easily cause random selection of a particular safe path in a relatively complicated game simply by placing the switches 25, 27, and 29 within the circles 41, 68, and 70. When placed within those position outlines, the players have no knowledge of which path is safe and which is dangerous. Consequently, only by starting and playing through the game will this be determined. In a preferred embodiment of the invention, the strips 33 are bifurcated to provide a sound for the safe path which sounds like the "beep-beep" of an antique automobile, while the danger paths give a relatively low-pitched "brap" sound. This adds significantly to the excitement of play.

It is not necessary to have exactly three paths at any multiple path interval, and any number of such paths which may within reason be placed upon the board may be used. Furthermore, the number of players may be increased or decreased without affecting the play of the game significantly except that with only three multiple path intervals the solution to the game will be determined relatively early; and, thus, it is quite conceivable that an increased number of multiple paths would be included.

Another feature of the invention is the simple manner in which the game is initially set up by the players. The board 12 is unfolded, and the selector switches 25, 27, 29, and sound generating module 23 are placed on the board 12 in their respective positions 41, 68, 70, and 66. The game is now ready for play, with all of the electrical connections having been made without the use of wires, plugs, or the like. The elimination of interconnecting wires and plugs yields a flat playing board 12 which can be manufactured at low cost. One method of construction is to print a single label which includes a colorful layout of the game path 14 as well as all of the conductive and resistive elements required for the electrical circuitry. This label is then applied to blank cardboard or plastic material to form the playing board 12. Printing of the label may be accomplished by means such as lithography, with the electrically conductive and resistive elements being formed by the use of conductive and resistive inks, respectively.

While there has been shown and described a preferred embodiment of the invention, various modifications and improvements might well be made by those skilled in the art without departing from the spirit and scope of the invention.

What is claimed is:

1. A game comprising in combination a game board having a track described on the board surface;

player pieces which are moved along the track;

detection means for automatically sensing an interval of the track along which a player has moved his player piece;

selection means for randomly designating intervals of the track, said selection means allowing the designated intervals to be changed during play of the game; and sound generator means responsive to the selection means and the detection means to automatically create a first or a second sound as the player moves his player piece along the track, the first sound being different from the second sound, the first sound being produced only when a player piece is detected by the detection means on the designated intervals, and the second sound being produced only when a player piece is detected by the detection means on the non-designated intervals.

2. The game according to claim 1 in which the detection means includes electrically conductive paths formed by a minimum of two spaced apart electrically conductive areas disposed along each interval of the track, and the player piece, which has an electrically conductive surface designed to contact the track whereby when the player piece is moved along one of the intervals the electrically conductive surface of the player piece bridges the electrically conductive areas of the track, thus forming one of the electrically conductive paths.

3. The game according to claim 2 in which the selection means includes switching means for randomly changing the electrical resistance of the electrically conductive paths, a first resistance designating a first interval and a second resistance designating a second interval.

4. The game according to claim 2 in which the sound generator means comprises an electronic module having electrically conductive areas on a surface of the module designed to contact the game board, means for connecting the module conductive areas to sound generator electronics and a power source, both within the module, and electrically conductive traces on the game board connected to the electrically conductive paths, the traces being disposed so that placement of the electronic sound generator in a designated position on the surface of the game board causes electrical connection between the generator electronics and the electrically conductive traces.

5. A game comprising in combination a game board having a track described on the board surface;

player pieces which are moved along the track;

detection means for sensing an interval of the track along which a player has moved his player piece, including electrically conductive paths formed by a minimum of two spaced apart electrically conductive areas disposed along each interval of the track, and the player piece, which has an electrically conductive surface designed to contact the track, whereby when the player piece is moved along one of the intervals the electrically conductive surface of the player piece bridges the electrically conductive areas of the track, thus forming one of the electrically conductive paths;

selection means for randomly designating intervals of the track, including switching means for randomly changing the electrical resistance of the electrically conductive paths, a first resistance designating a first interval and a second resistance designating a second interval; and sound generator means responsive to the selection means and the detection means to create a first or a second sound as the player moves his player piece along the track, the sound generator means creating a sound in response to the magnitude of the electrical resistance of the electrically conductive path with the first resistance creating the first sound, and the second resistance creating the second sound.

6. A game comprising in combination a game board having a track described on the board surface;

player pieces which are moved along the track;

detection means for sensing an interval of the track along which a player has moved his player piece, including electrically conductive paths formed by a minimum of two spaced apart electrically conductive areas disposed along each interval of the track, and the player piece, which has an electrically conductive surface designed to contact the track whereby when the player piece is moved along one of the intervals the electrically conductive surface of the player piece bridges the electrically conductive areas of the track, thus forming one of the electrically conductive paths;

selection means for randomly designating intervals of the track including switching means for randomly changing the electrical resistance of the electrically conductive paths, a first resistance designating a first interval and a second resistance designating a second interval, the switching means further including a switching element having an electrically conductive area on a surface of the element designed to contact the surface of the game board, electrically resistive elements which are disposed on the surface of the game board in a manner permitting connection of the resistive elements to the electrically conductive paths, and placement of the electrically conductive paths in an area of the game board designated for placement of the switching element, so that placement of the switching element in its designated area on the game board causes the conductive area of the switching element to electrically shunt one of the resistive elements and thereby change the electrical resistance of one of the electrically conductive paths, the random orientation of the switching element determining the value of resistance for each conductive path; and sound generator means responsive to the selection means and the detection means to create a first or a second sound as the player moves his player piece along the track.

7. The game according to claim 6 in which the game board is formed by attaching a single printed label to a surface of the board, the label containing the description of the track, the electrically conductive paths of the detection means, and the electrically resistive elements of the selection means.

8. A game comprising in combination a game board having a track described on the board surface;

player pieces which are moved along the track;

detection means for sensing an interval of the track along which a player has moved his player piece, including electrically conductive paths formed by a minimum of two spaced apart electrically conductive areas disposed along each interval of the track, and the player piece, which has an electrically conductive surface designed to contact the track whereby when the player piece is moved along one of the intervals the electrically conductive surface of the player piece bridges the electrically conductive areas of the track, thus forming one of the electrically conductive paths;

selection means for randomly designating intervals of the track; and sound generator means responsive to the selection means and the detection means to create a first or a second sound as the player moves his player piece along the track, the sound generator means further including an electronic module having electrically conductive areas on a surface of the module designed to contact the game board, means for connecting the module conductive areas to sound generator electronics and a power source, both within the module, and electrically conductive traces on the game board connected to the electrically conductive paths, the traces being disposed so that placement of the electronic sound generator in a designated position on the surface of the game board causes electrical connection between the generator electronics and the electrically conductive traces, and wherein the game board is designed to fold, the surface of the board being designed to avoid the placement of any conductive paths or conductive traces on or across the line of fold, the resulting two electrically isolated sections of the board being electrically connected together and to the electronic module of the sound generator means by designating the position on the game board for the placement of the electrically conductive areas on the surface of the electronic module and the conductive traces on the board surface being disposed so that when the module is placed in its position on the game board, the electrically conductive areas on the surface of the module serve to bridge across the folding line and electrically connect the isolated circuitry to each other and to the electronic module.

9. A game comprising in combination a flat, foldable game board having a track described on the board surface and having parallel path sections along at least one interval of the track;

electrically conductive player pieces which are moved along the track and which bridge across electrically conductive areas disposed along the track, forming electrically conductive paths;

a switching element and resistive elements for each interval of the track which randomly designate parallel paths as a first and second parallel path by having the switching element randomly shunt the resistive elements, thereby varying the resistance of the electrically conductive paths; and an electronic sound generator responsive to the resistance of the electrically conductive paths to create a first or a second sound if the player has moved his player piece along the first or second parallel path, respectively, the first sound being different from the second sound.

* * * * *